United States Patent [19]

Dabney et al.

[11] Patent Number: 4,779,293

[45] Date of Patent: Oct. 25, 1988

[54] FORMED WIRE BOX SPRING WITH SPRING WIRE DECK

[75] Inventors: Upton R. Dabney; John P. Kitchen, both of Georgetown, Ky.

[73] Assignee: Hoover Group, Inc., Roswell, Ga.

[21] Appl. No.: 72,806

[22] Filed: Jul. 14, 1987

[51] Int. Cl.[4] ..... A47C 23/02

[52] U.S. Cl. ..... 5/247; 5/255; 5/268

[58] Field of Search ..... 5/247, 255, 260, 267, 5/268, 273, 275–277; 267/100, 103–107

[56] References Cited

U.S. PATENT DOCUMENTS

| | | | |
|---|---|---|---|
| 3,825,960 | 7/1974 | Inman et al. | 5/247 |
| 4,120,058 | 10/1978 | Kitchen et al. | 5/247 |
| 4,253,208 | 3/1981 | Hancock et al. | 5/247 |
| 4,470,584 | 9/1984 | Mizelle | 5/247 X |

*Primary Examiner*—Michael F. Trettel

*Attorney, Agent, or Firm*—Harness, Dickey & Pierce

[57] ABSTRACT

A box spring assembly in which the mattress support deck is formed by a plurality of components all of which are formed from spring wire to thereby achieve a support deck of increased strength and improved durability. In addition, the components are structurally interrelated and clipped together so as to restrain relative movement of the components to thereby achieve a box spring assembly of improved stability.

4 Claims, 4 Drawing Sheets

FORMED WIRE BOX SPRING WITH SPRING WIRE DECK

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,371,152; 4,398,705; 4,470,584 and 4,452,438.

Box spring assemblies of the general type shown in the above list of patents, all of which are owned by to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

The present invention provides a box spring assembly which utilizes a wire deck or platform that provides improved support for a mattress. This is achieved by constructing the box spring assembly so that the mattress support deck is formed entirely of spring wire instead of the usual basic wire which is not nearly so strong and durable.

Secondarily, the improved box spring of this invention has the advantage of stability which prevents sideways sway. This is achieved by notching and clipping the deck wires to each other and to the support springs so that the component elements of the assembly can not sway.

SUMMARY OF THE INVENTION

The box spring assembly of this invention consists of a rectangular frame having side rails, end rails, and a plurality of cross rails that are generally parallel to each other and to the end rails and are substantially perpendicular to the side rails. The box spring assembly also includes a generally horizontal mattress support deck disposed a predetermined distance above the frame and formed entirely of spring wire. Spring wire is a high carbon heat treated steel which has the "springiness" characteristic necessary to enable it to deflect under load and then return to its initial position when the load is released. Spring wire usually has a carbon content in the range of 0.6–0.9 percent and is sometimes referred to as "high carbon" wire. This is in contrast to the mattress support decks in box springs commonly in use which are formed of a welded wire grid consisting entirely of basic wire. Basic wire is a low carbon, non-heat treated steel that lacks the "springiness" characteristic of spring wire. Basic wire usually contains carbon in the range of 0.08–0.1 percent and a carbon content generally within this range is what is referred to as "low carbon". Basic wire lacks the durability and strength of spring wire.

The mattress support deck in the present invention is formed of a plurality of a substantially straight wire members arranged criss-cross fashion, some extending lengthwise of the frame and other crosswise of the frame and a border wire of generally rectangular shape in defining the load supporting area of the deck. A plurality of deck support springs are arranged between the deck and the frame so as to yieldably support the deck on the frame. These springs include vertically yieldable portions mounted at their lower ends on the frame and terminating at their upper ends in upwardly deck attaching portions which form part of the spring wire deck. These deck attaching portions are also arranged in an interacting secured relation with the deck wires so as to stabilize the deck against side ways sway.

The result is an improved formed wire box spring assembly which has a mattress supporting deck of increased strength and durability in which is maintained in a stabilized position on the frame by the inner active secured relation of the box spring components which prevents relative movement of the component.

Further objects, features, and advantages of this invention will become apparent from a consideration of the following description, the appended claims, and the accompanying drawing in which:

Figure 1:
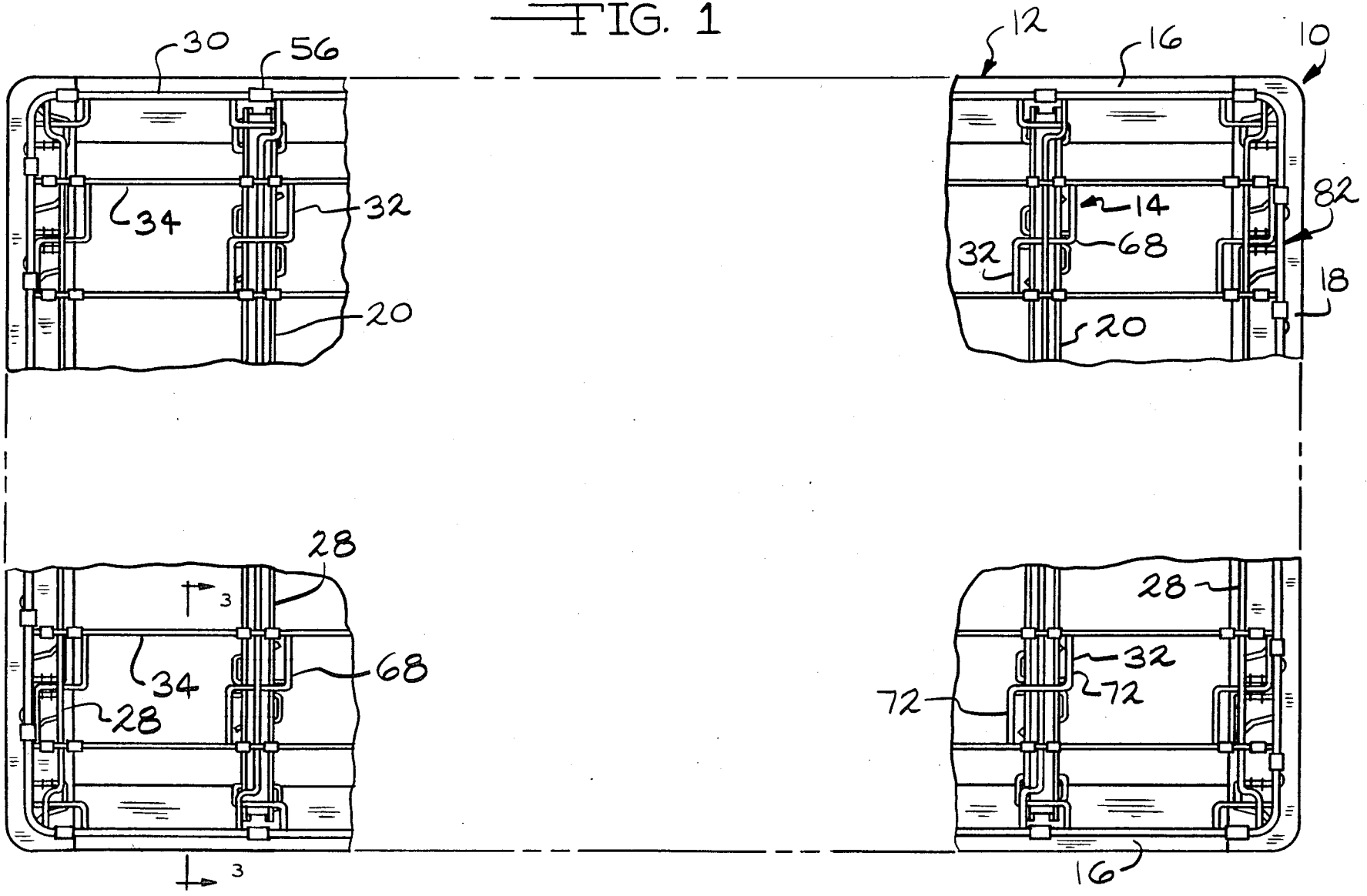
FIG. 1 is a plan view of the box spring assembly of this invention with the middle portion of the spring assembly being broken away for ease of illustration.

With reference to the drawing, the box spring assembly of this invention, indicated generally at 10, is illustrated in FIG. 1 as consisting of a generally rectangular, horizontally disposed frame 12, and a wire spring assemblage 14 mounted on the top side of the frame 12. The frame 12 has wooden side rails 16 and end rails 18 and metal cross rails 20 which are secured to and extend between the side rails 16.

Figure 2:
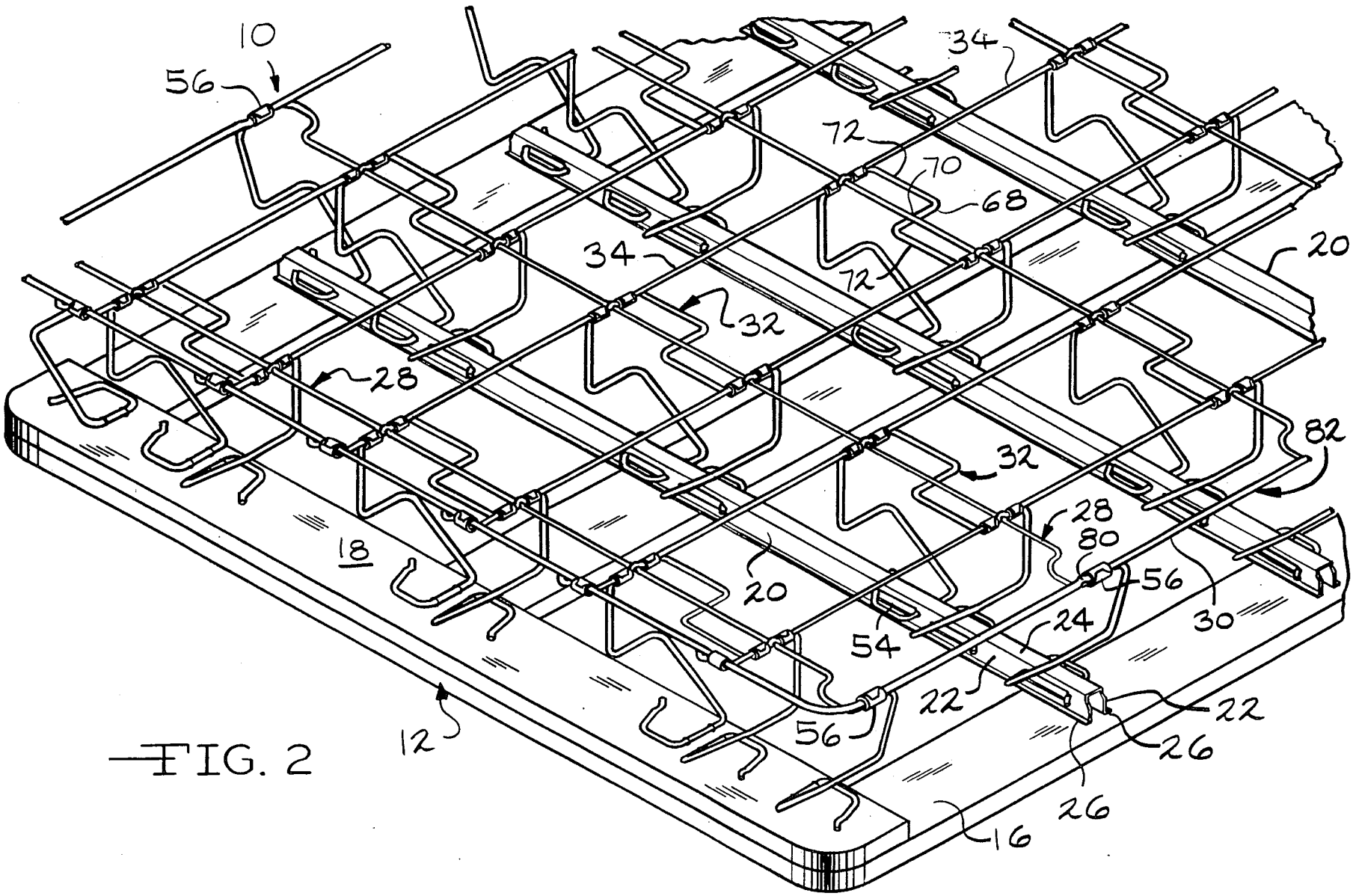
FIG. 2 is a fragmentary perspective view of one end portion of the box spring assembly of this invention.

As best appears in FIG. 2, each of the cross rails 20 is of a special shape, and includes a pair of upright webs 22 which are spaced apart and connected at their upper edges by a top plate 24. At their low edges, the webs 22 are provided with oppositely extending flat flanges 26. The cross rails are described in greater detail in copending U.S. patent application Ser. No. 72,964, filed July 14, 1987.

The spring assemblage 14 includes a plurality of main cross springs 28 two of which are supported on the end rails 18 and the balance of which are mounted on the cross rails 20. The assemblage 14 also includes a rectangular border wire 30 supported on the main springs 28, support spring modules 32 and substantially straight deck wires 34.

Each of the main springs 28 (FIGS. 3 and 4) consists of a unitary wire body 36, formed of spring wire, bent in a predetermined configuration. The body 36 has an elongated substantially straight main section 38 which is of a length corresponding substantially to the width of the box spring frame, namely, the distance between the side rails 16. At its ends, the main section 38 is formed with horizontally offset end portions 40 which are integrally formed with vertically yieldable formed wire spring sections 42. Each formed wire spring section 42 includes an upper torsion bar 44, a lower torsion bar 46 and an intermediate torsion bar 48. Upper and lower connecting bars 50 and 52 connect the torsion bars 44, 46 and 48 and the spring section 42 terminates at its lower end in a convention mounting foot 49.

The straight spring section 38 and the end torsion bars 44 are in the same horizontal plane and are relatively arranged so that the straight section 38 is horizontally aligned with central sections of the torsion bars 44 so that the torsion bars 44 are substantially symmetrical with respect to the main sections 38. As a result, when the main springs 38 are supported on the cross rails 20, the straight wire sections 38 are vertically aligned with the cross rails 20. The main springs 28 are conventionally mounted on the cross rails 20 by inserting the mounting feet 49 through locating slots 54 in the cross rails 20, as described in detail in copending application Ser. No. 72,964, filed July 14, 1987.

Similarly, the main springs 28 at the ends of the box spring assembly 10 are secured by conventional staples on the feet 49 to the end rails 18 so that the main spring sections 38 are vertically aligned with the frame end rails 18.

The rectangular border wire 30 is of substantially the same size as the box spring frame 12 and is supported on the main springs 28 by positioning straight side sections of the border wire 30 in a side by side relation with the upper torsion bars 44 on the springs 28 and securing the side by side sections with conventional wrap around clips 56.

Figure 7:
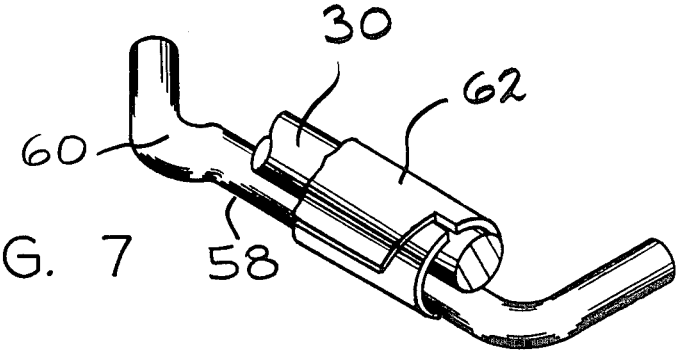
FIG. 7 is an enlarged fragmentary perspective view illustrating the connection of a deck wire to the border wire in the box spring assembly of this invention.

As shown in FIG. 1, the long wires 34 which extend lengthwise of the box spring 10 are arranged in a criss-cross fashion with the main spring wire sections 38 and are provided at their ends with short straight wire sections 58 (FIG. 7) which terminate in offset end sections 60. The wire sections 58 are arranged side by side with the border wire 30 at the ends of the box spring and are secured thereto by clips 62 which encircle the side by side wire sections so that the offset end sections 60 coact with the border wire 30 so as to restrain relative movement of the deck wires 34 and border wire 30.

The spring modules 32 (FIGS. 1, 2 and 3) are disclosed in detail in U.S. Pat. No. 4,470,584 owned by the assignee of this application. Each spring module 32 is essentially a shortened version of the main spring 28 with a particularly shaped deck attaching portion 64. Each spring module attaching portion 64 has a pair of end torsion bars 66 (FIGS. 3 and 5) with a Z-shaped connecting section 68 consisting of a central bar 70 parallel to the torsion bars 66 and positioned midway therebetween and supporting bars 72 which extend between the torsion bars 66 and the supporting bar 70.

Figure 3:
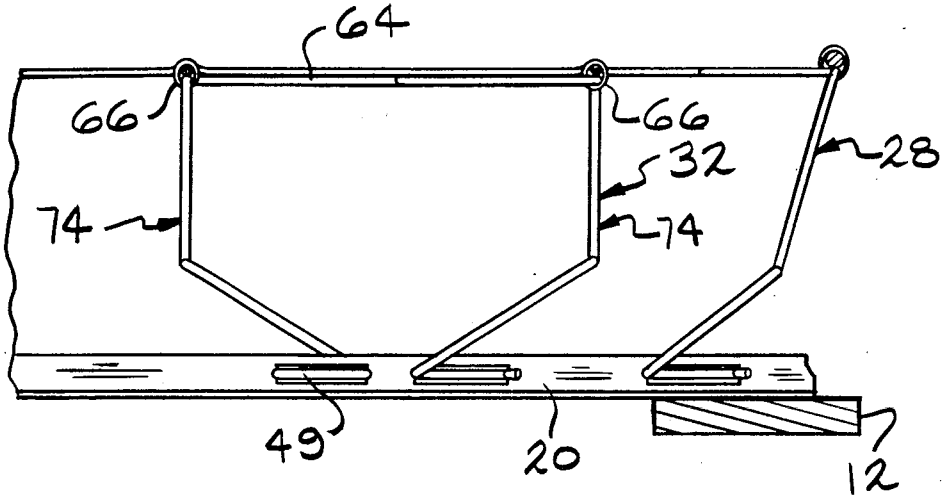
FIG. 3 is an enlarged, fragmentary detail sectional view of a portion of the box spring assembly of this invention as viewed from substantially the line 3—3 in FIG. 1.

At the ends of the deck attaching portion 64, the spring module 32 is provided with upright vertically yieldable formed wire spring sections 74 which are substantially identical to the formed wire spring sections 42 at the ends of the main springs 28. Like numerals are used, therefore, on the spring sections 74 to indicate like portions of the spring sections 42. The upright column or connecting bar 50 in the end section 74 is illustrated in FIG. 3 as being more upright than the corresponding bar in the spring section 42, but it is to be understood that this bar inclination can be varied, or can be the same in the end sections 42 and 74 so long as they are generally upright. The exact inclination forms no part of the present invention.

Figure 4:
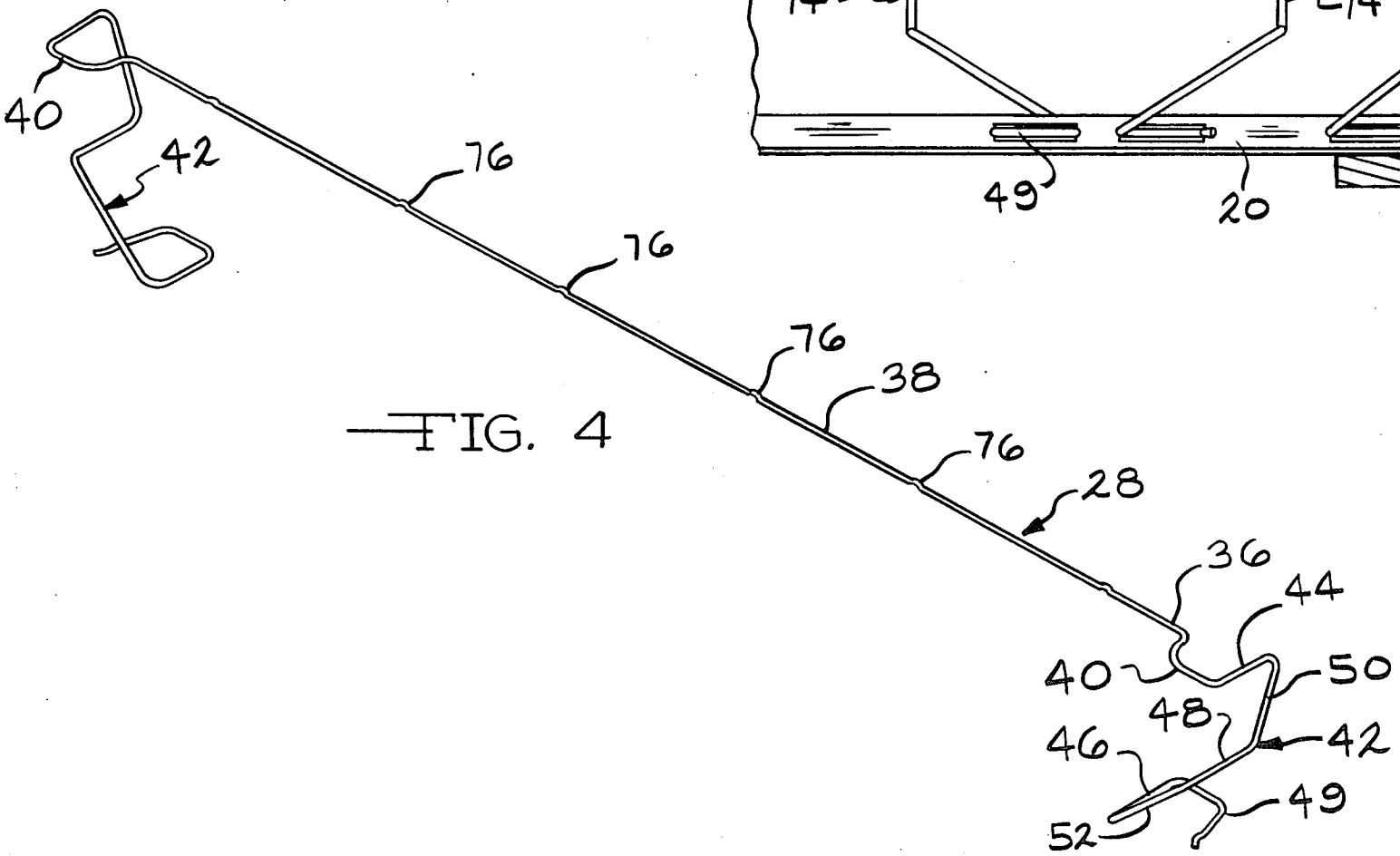
FIG. 4 is a perspective view of a main spring in the box spring assembly of this invention.
Figure 5:
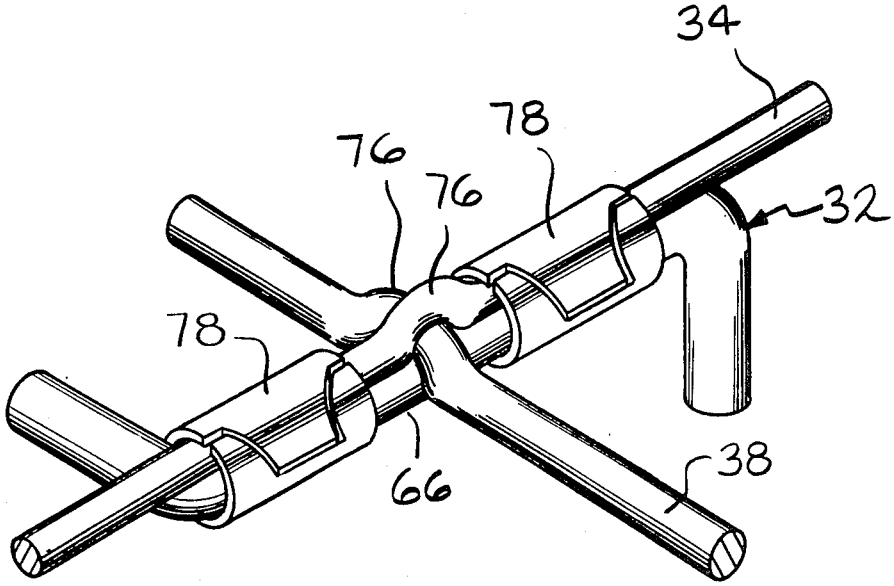
FIG. 5 is an enlarged fragmentary perspective view of a portion of the spring wire deck in the box spring assembly of this invention, showing spring wires which intersect and are supported on a spring module.

As shown in FIG. 4, the main straight section 38 of the main spring 28 is provided with vertically offset notch-like portions 76, which are generally curved, as shown in FIG. 5 so that they can nest over the top sides of the spring module torsion bars 66. Similarly, the long wires 34 are formed with vertically offset notch like portions 76 which can nest on the top sides of the main spring portions 76.

As shown in FIG. 5, at each intersection of the wires 34 and 38, the wire 34 is nested on the top side of the wire 38 and the wire 38 is in turn nested on a spring module torsion bar 66 at a position substantially midway between the ends of the torsion bar 66. Clips 78 wrap around the long wire 34 and the torsion bar 66 on opposite sides of the main spring deck wire 38. As a result, at each intersection of the deck wires 34 and 38, relative movement of the deck wires and the spring modules 32 is restrained by the notching of the wires and the arrangement of the wires so that the wires 34 are clipped to the spring module on opposite sides of the wire 38.

Figure 6:
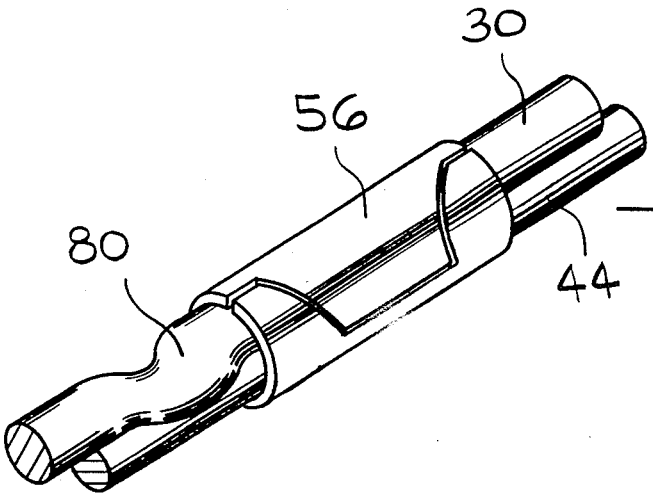
FIG. 6 is an enlarged fragmentary perspective view showing the attachment of a main spring to the border wire in the box spring assembly of this invention.

This assembly prevents sideways sway of the spring assemblage 14 on the frame 12 which is a highly desirable feature of a box spring assembly. As shown in FIG. 6, the border wire 30 is similarly formed with horizontally offset notch like portions 80 which are located so that they are adjacent the main spring torsion bars 44 and the clips 56 which connect the torsion bars 44 to the border wire 30. The notch-like portions 80 thus prevent the clips 56 from moving on the border wire 30 to thus further contribute to the anti-sway structure of the present invention.

From the above description it is seen that this invention provides a box spring assembly 10 which is improved from the standpoint of providing an all spring-wire mattress support deck 82 at the top of the formed wire box spring assembly 10. The deck 82 consists of the wires 34 and 38, the border wire 30 and the attaching portions 64 of the spring modules 32. All of these components are formed of spring wire which is much stronger and more durable than the conventional basic wire welded wire grids. In addition, the box spring assembly of this invention requires no welding. From an operational standpoint, the box spring assembly of this invention is improved because it eliminates side ways sway by clipping the spring components together so as to positively preclude the relative movement which causes sideways sway.

What is claimed is:

1. A box spring assembly comprising a generally horizontal rectangular frame having corners and a generally horizontal mattress support deck disposed a predetermined distance above said frame and formed of spring wire, said deck including a plurality of substantially straight wire members arranged criss-cross fashion, some of said wire members extending lengthwise of said frame and others of said wire members extending crosswise of said frame and each of said wire members being formed of spring wire, and a border wire having corner portions located above and substantially vertically aligned with the corners of said frame; a plurality of deck support springs arranged between said deck and said frame so as to yieldably support said deck on said frame, said springs including vertically yieldable portions mounted at their lower ends on said frame and terminating at their upper ends in deck attaching portions at the upper ends of said vertically yieldable portions, each of said deck attaching portions including end straight wire sections arranged in a side-by-side supporting relation with straight sections of a pair of said deck wire members, clip means connecting said straight wire sections, and deck attaching portion also being arranged in a supporting relation with spaced portions of another one of said deck wire members that is generally perpendicular to said pair of said deck wire members, some of said deck wire members extending crosswise of said frame and being integrally formed at their ends with formed wire spring sections attached to said border wire and supported on said frame, others of said deck wire members extending lengthwise of said frame and being secured at their ends to said border wire.

2. A box spring assembly according to claim 1 wherein said frame includes end rails and cross rails and some of said formed wire spring sections are supported on said end rails and others of said formed wire spring sections are supported on said cross rails.

3. The box spring assembly according to claim 1 wherein said deck wire members are provided at predetermined locations with transversely offset notch-like portions, said portions being located so that said portions interfit at the intersections of deck wire members arranged in said criss-cross relation to thereby restrain relative movement of said wire members in said deck, said straight wire sections in said spring deck attaching portions being located at said intersections and said clip means being on opposite sides of an intersecting wire at each of said intersections and coacting with said notch like portions of said deck wire members to maintain said deck wires and said support springs in desired relative positions at said intersections.

4. The box spring assembly according to claim 3 wherein said other deck wire members are formed at the ends thereof with relatively straight wire sections which terminate in offset end sections, said straight sections being arranged side by side with straight sections of said border wire, and clip means encircling said side by side sections so as to secure said deck wire members to said border wire in positions such that said offset end sections coact with said border wire so as to restrain relative movement of said deck wire members and said border wire.

* * * * *